US008172959B2

(12) United States Patent
Sakaguchi et al.

(10) Patent No.: US 8,172,959 B2
(45) Date of Patent: May 8, 2012

(54) AUSTENITIC STAINLESS STEEL, MANUFACTURING METHOD FOR THE SAME, AND STRUCTURE USING THE SAME

(75) Inventors: Yasuhiro Sakaguchi, Hyogo (JP); Toshihiko Iwamura, Hyogo (JP); Hiroshi Kanasaki, Hyogo (JP); Hidehito Mimaki, Hyogo (JP); Masaki Taneike, Hyogo (JP); Shunichi Suzuki, Tokyo (JP); Kenrou Takamori, Tokyo (JP); Suguru Ooki, Tokyo (JP); Naoki Anahara, Tokyo (JP); Naoki Hiranuma, Tokyo (JP); Toshio Yonezawa, Hyogo (JP)

(73) Assignees: Mitsubishi Heavy Industries, Ltd., Tokyo (JP); The Tokyo Electric Power Company, Inc., Tokyo (JP)

( * ) Notice: Subject to any disclaimer, the term of this patent is extended or adjusted under 35 U.S.C. 154(b) by 697 days.

(21) Appl. No.: 10/585,885

(22) PCT Filed: Jan. 13, 2005

(86) PCT No.: PCT/JP2005/000274
§ 371 (c)(1),
(2), (4) Date: Jul. 10, 2008

(87) PCT Pub. No.: WO2005/068674
PCT Pub. Date: Jul. 28, 2005

(65) Prior Publication Data

US 2008/0308198 A1 Dec. 18, 2008

(30) Foreign Application Priority Data

Jan. 13, 2004 (JP) ..... 2004-004928

(51) Int. Cl.
*C22C 38/44* (2006.01)
*C21D 8/10* (2006.01)
*C21D 9/08* (2006.01)

(52) U.S. Cl. ..... 148/327; 148/442; 148/592; 148/593; 148/610; 148/611; 148/607; 148/326; 148/419; 376/900; 420/52; 420/586.1

(58) Field of Classification Search ..... 148/326, 148/327, 442, 419, 592, 593, 610, 611; 420/43, 420/52, 586.1; 376/900
See application file for complete search history.

(56) References Cited

U.S. PATENT DOCUMENTS 3,563,728 A * 2/1971 Allio et al. ..... 420/36
(Continued)

FOREIGN PATENT DOCUMENTS

EP 0 530 725 A1 3/1993
(Continued)

OTHER PUBLICATIONS

International Search Report PCT/JP2005/000274, date of mailing May 10, 2005.
(Continued)

*Primary Examiner* — Deborah Yee
(74) *Attorney, Agent, or Firm* — Westerman, Hattori, Daniels & Adrian, LLP

(57) ABSTRACT

There are provided an austenitic stainless steel having high stress corrosion crack resistance, characterized by containing, in percent by weight, 0.030% or less C, 0.1% or less Si, 2.0% or less Mn, 0.03% or less P, 0.002% or less S, 11 to 26% Ni, 17 to 30% Cr, 3% or less Mo, and 0.01% or less N, the balance substantially being Fe and unavoidable impurities; a manufacturing method for an austenitic stainless steel, characterized in that a billet consisting of the said austenitic stainless steel is subjected to solution heat treatment at a temperature of 1000 to 1150° C.; and a pipe and a in-furnace structure for a nuclear reactor to which the said austenitic stainless steel is applied.

11 Claims, 10 Drawing Sheets

U.S. PATENT DOCUMENTS

| | | | |
|---|---|---|---|
| 4,643,767 | A | 2/1987 | Crook et al. |
| 4,720,435 | A | 1/1988 | Crook et al. |
| 5,316,597 | A | 5/1994 | Kato et al. |
| 5,458,156 | A | 10/1995 | Okubo et al. |
| 5,830,408 | A | 11/1998 | Azuma et al. |

FOREIGN PATENT DOCUMENTS

| | | | | |
|---|---|---|---|---|
| EP | 0530725 | | * | 3/1993 |
| EP | 0789089 | | * | 8/1997 |
| JP | 54-69516 | A | | 6/1979 |
| JP | 64-9379 | B2 | | 2/1989 |
| JP | 2-97651 | A | | 4/1990 |
| JP | 03-267350 | A | | 11/1991 |
| JP | 4-14182 | B2 | | 3/1992 |
| JP | 04-072038 | A | | 3/1992 |
| JP | 5-59494 | A | | 3/1993 |
| JP | 06-122946 | A | | 5/1994 |
| JP | 7-209485 | A | | 8/1995 |
| JP | 07-209485 | A | | 8/1995 |
| JP | 08-060307 | A | | 3/1996 |
| JP | 10-317104 | A | | 12/1998 |

OTHER PUBLICATIONS

Supplementary European Search Report dated Aug. 1, 2007, issued in European Application No. 05703513.1.

* cited by examiner (a)

(b)

[図4]

[図6]

[図8]

(a)

(b)

(a)

(b)

AUSTENITIC STAINLESS STEEL, MANUFACTURING METHOD FOR THE SAME, AND STRUCTURE USING THE SAME

TECHNICAL FIELD

The present invention relates to an austenitic stainless steel having high stress corrosion crack resistance, a manufacturing method for the same, and a structure using the same.

BACKGROUND ART

Mo-containing low-carbon austenitic stainless steel has been used frequently as a component material for pipes and in-furnace structures of nuclear reactors because it is difficult to sensitize and has higher stress corrosion crack resistance under high-temperature and pressure water than an austenitic stainless steel containing no Mo.

However, in recent years, it has been revealed that in Mo-containing low-carbon austenitic stainless steel, stress corrosion cracks develop from regions which have been hardened by grinding or welding heat distortion. These cracks can propagate as intergranular stress corrosion cracking even if the stainless steel is not sensitized. Such a phenomenon is a new phenomenon that has not been studied conventionally. To take measures against this phenomenon, the development of a stainless steel having high stress corrosion crack resistance has become a pressing concern.

DISCLOSURE OF THE INVENTION

Problems to be Solved by the Invention

In view of the above problem, the inventors earnestly conducted studies to develop an austenitic stainless steel that is difficult to sensitize, is less liable to generate a stress corrosion crack from a region hardened by grinding or welding heat distortion, the generation of stress corrosion crack being a drawback of the Mo-containing low-carbon austenitic stainless steel, is configured so that even if a stress corrosion crack is generated, the stress corrosion crack is less liable to propagate, and can be used for a long period of time as a component material for pipes and in-furnace structures of nuclear reactors; and a manufacturing method for the austenitic stainless steel.

To attain the above object, the inventors undertook many experiments. As a result, the following was revealed. Conventionally, in Mo-containing low-carbon austenitic stainless steel, C content has been decreased from the viewpoint of prevention of sensitization. However, since the decrease in C content lowers the strength level such as yield strength and tensile strength, about 0.08 to 0.15% of N has been added to keep a predetermined strength level. However, in the case where N forms a solid solution in the austenitic crystal matrix, the stacking fault energy of austenite is decreased, and work hardening occurs easily. Also, if heat is applied, Cr nitride deposits, and Cr content in the austenitic crystal matrix is decreased, which presumably decreases the corrosion resistance.

Means for Solving the Problems

To enhance the stacking fault energy of austenite, the inventors produced, on a trial basis, various types of Mo-containing low-carbon austenitic stainless steels in which N content and, in addition, Si content were changed systematically, and carried out stress corrosion crack tests in high-temperature and pressure water to make a comparison. As a result, it was found that if N content is 0.01% or lower and Si content is 0.1% or lower, the austenite matrix is less liable to be work hardened, and thus the stress corrosion crack resistance of a cold-worked material was increased significantly.

Also, the inventors produced, on a trial basis, a Mo-containing low-carbon austenitic stainless steel in which Cr content was increased to increase the stress corrosion crack generation life and to prevent a shortage of strength such as yield strength and tensile strength caused by the decrease in N content and Si content, and Ni content was increased to prevent a shortage of stability of austenite caused by the decrease in C content and N content, and carried out stress corrosion crack tests in high-temperature and pressure water to make a comparison. As a result, it was found that the stress corrosion crack resistance was increased significantly.

Further, it was found that in a Mo-containing low-carbon austenitic stainless steel in which Ca content and Mg content are kept at 0.001% or lower or any one of Zr, B and Hf is added, a Mo-containing low-carbon austenitic stainless steel in which (Cr equivalent)−(Ni equivalent) is controlled to −5 to +7%, and a Mo-containing low-carbon austenitic stainless steel in which Cr carbide depositing in harmonization with the austenite crystal matrix of M23C6 is deposited at the grain boundary, the intergranular stress corrosion crack propagation velocity under high-temperature and pressure water can be decreased significantly. Also, it was found that in a Mo-containing low-carbon austenitic stainless steel in which (Cr equivalent)−(Ni equivalent) is controlled to −5 to +7%, and/or the Cr equivalent/Ni equivalent is controlled to 0.7 to 1.4 as well, the intergranular stress corrosion crack propagation velocity under high-temperature and pressure water can be decreased significantly.

Furthermore, it was found that in a Mo-containing low-carbon austenitic stainless steel in which the stacking fault energy (SFE) calculated by the following equation (1):

$$SFE(mJ/m^2)=25.7+6.2\times Ni+410\times C-0.9\times Cr-77\times N-13\times Si-1.2\times Mn \quad (1)$$

is 100 ($mJ/m^2$) or higher, or in which (Cr equivalent)−(Ni equivalent) is controlled to −5 to +7%, and/or the Cr equivalent/Ni equivalent is controlled to 0.7 to 1.4 while the above-described condition is met, the intergranular stress corrosion crack propagation velocity under high-temperature and pressure water can be decreased more significantly.

Therefore, the inventors obtained a knowledge that a Mo-containing low-carbon austenitic stainless steel can be obtained in which the generation of stress corrosion crack caused by hardening due to working distortion or welding heat distortion of the Mo-containing low-carbon austenitic stainless steel is prevented, and even if a stress corrosion crack is generated, the crack is less liable to propagate.

The present invention was completed from the above-described viewpoint.

That is to say, the present invention provides an austenitic stainless steel having high stress corrosion crack resistance, characterized by containing, in percent by weight, 0.030% or less C, 0.1% or less, preferably 0.02% or less, Si, 2.0% or less Mn, 0.03% or less P, 0.002% or less, preferably 0.001% or less, S, 11 to 26% Ni, 17 to 30% Cr, 3% or less Mo, and 0.01% or less N, the balance substantially being Fe and unavoidable impurities.

Also, the present invention provides an austenitic stainless steel having high stress corrosion crack resistance, characterized by containing, in percent by weight, 0.030% or less C, 0.1% or less, preferably 0.02% or less, Si, 2.0% or less Mn, 0.03% or less P, 0.002% or less, preferably 0.001% or less, S, 11 to 26% Ni, 17 to 30% Cr, 3% or less Mo, 0.01% or less N, 0.001% or less Ca, 0.001% or less Mg, and 0.004% or less, preferably 0.001% or less, O, the balance substantially being Fe and unavoidable impurities.

Also, the present invention provides an austenitic stainless steel having high stress corrosion crack resistance, characterized by containing, in percent by weight, 0.030% or less C, 0.1% or less, preferably 0.02% or less, Si, 2.0% or less Mn, 0.03% or less P, 0.002% or less, preferably 0.001% or less, S, 11 to 26% Ni, 17 to 30% Cr, 3% or less Mo, 0.01% or less N, 0.001% or less Ca, 0.001% or less Mg, 0.004% or less, preferably 0.001% or less, O, and 0.01% or less of any one of Zr, B and Hf, the balance substantially being Fe and unavoidable impurities.

Further, the present invention provides the austenitic stainless steel having high stress corrosion crack resistance described in any one of the above items, characterized in that (Cr equivalent)−(Ni equivalent) is in the range of −5% to +7%. The value of (Cr equivalent)−(Ni equivalent) is preferably 0%.

Herein, the Cr equivalent is given, for example, by $$\text{Cr equivalent}=[\%\ \text{Cr}]+[\%\ \text{Mo}]+1.5\times[\%\ \text{Si}]+0.5\times[\%\ \text{Nb}]\ \text{(expressed in percent by weight)}$$

or $$\text{Cr equivalent}=[\%\ \text{Cr}]+1.37\times[\%\ \text{Mo}]+1.5\times[\%\ \text{Si}]+3\times[\%\ \text{Ti}]+2\times[\%\ \text{Nb}]\ \text{(expressed in percent by weight)}$$

or the like.

Also, the Ni equivalent is given, for example, by $$\text{Ni equivalent}=[\%\ \text{Ni}]+30\times[\%\ \text{C}]+30\times[\%\ \text{N}]+0.5\times[-\text{Mn}]\ \text{(expressed in percent by weight)}$$

or $$\text{Ni equivalent}=[\%\ \text{Ni}]+22\times[\%\ \text{C}]+14.2\times[\%\ \text{N}]+0.31\times[-\text{n}]+[\%\ \text{Cu}]\ \text{(expressed in percent by weight)}$$

or the like.

Still further, the present invention provides the austenitic stainless steel having high stress corrosion crack resistance described in any one of the above items, characterized in that Cr equivalent/Ni equivalent is 0.7 to 1.4.

Still further, the present invention provides the austenitic stainless steel having high stress corrosion crack resistance described in any one of the above items, characterized in that stacking fault energy (SFE) calculated by the following equation (1):

$$\text{SFE}(\text{mJ/m}^2)=25.7+6.2\times\text{Ni}+410\times\text{C}-0.9\times\text{Cr}-77\times\text{N}-13\times\text{Si}-1.2\times\text{Mn} \quad (1)$$

is 100 ($\text{mJ/m}^2$) or higher.

In addition, the present invention provides a manufacturing method for a stainless steel, characterized in that a billet (steel plate, steel forging, or steel pipe) consisting of the austenitic stainless steel described in any one of the above items is subjected to solution heat treatment at a temperature of 1000 to 1150° C. Further, the present invention provides a manufacturing method for a stainless steel, characterized in that a billet (steel plate, steel forging, or steel pipe) consisting of the austenitic stainless steel described in any one of the above items is subjected to solution heat treatment at a temperature of 1000 to 1150° C., thereafter being subjected to cold working of 10 to 30%, and is then subjected to intergranular carbide precipitation heat treatment at a temperature of 600 to 800° C. for 1 to 50 hours.

All of the austenitic stainless steels described above can be used suitably, for example, especially as an austenitic stainless steel for a nuclear reactor member such as a pipe or an in-furnace structure for a nuclear reactor. Also, the stainless steel obtained by the above-described manufacturing method can also be used suitably as an austenitic stainless steel for a nuclear reactor member, namely, as a component material, such as a pipe or an in-furnace structure, for a nuclear reactor.

ADVANTAGES OF THE INVENTION

As described above, the Mo-containing low-carbon austenitic stainless steel in accordance with the present invention is less liable to sensitize, has high stress corrosion crack resistance, and is configured so that even if a stress corrosion crack is generated, the stress corrosion crack is less liable to propagate. By applying this austenitic stainless steel to a pipe or an in-furnace structure of a nuclear reactor, which is a part of reactor component members, the reactor component member can be used for a long period of time.

That is to say, for the Mo-containing low-carbon austenitic stainless steel in accordance with the present invention, by making the N content and Si content proper, hardening caused by working distortion or welding heat distortion, which is a cause for stress corrosion cracking, can be restrained. Also, by making the Cr content and Ni content proper and by making the Cr equivalent and Ni equivalent proper, the stress corrosion crack generation life is increased. Farther, the Ca content, Mg content, etc. for weakening the grain boundary are made proper, and further Zr, B or Hf for strengthening the grain boundary is added, or Cr carbide is deposited at the grain boundary in harmonization with the crystal matrix, by which intergranular stress corrosion cracking is made less liable to propagate. In addition, in the manufacturing method in accordance with the present invention, after subjecting to solution heat treatment at a temperature of 1000 to 1150° C., cold working of 10 to 30% is performed. The resultant product then undergoes a precipitation heat treatment at a temperature of 600 to 800° C. for 1 to 50 hours, by which Cr carbide can be deposited at the grain boundary in harmonization with the crystal matrix.

Hereunder, the present invention is explained in detail with reference to an embodiment. The present invention is not subjected to any restriction by this embodiment.

BEST MODE FOR CARRYING OUT THE INVENTION

Figure 1:
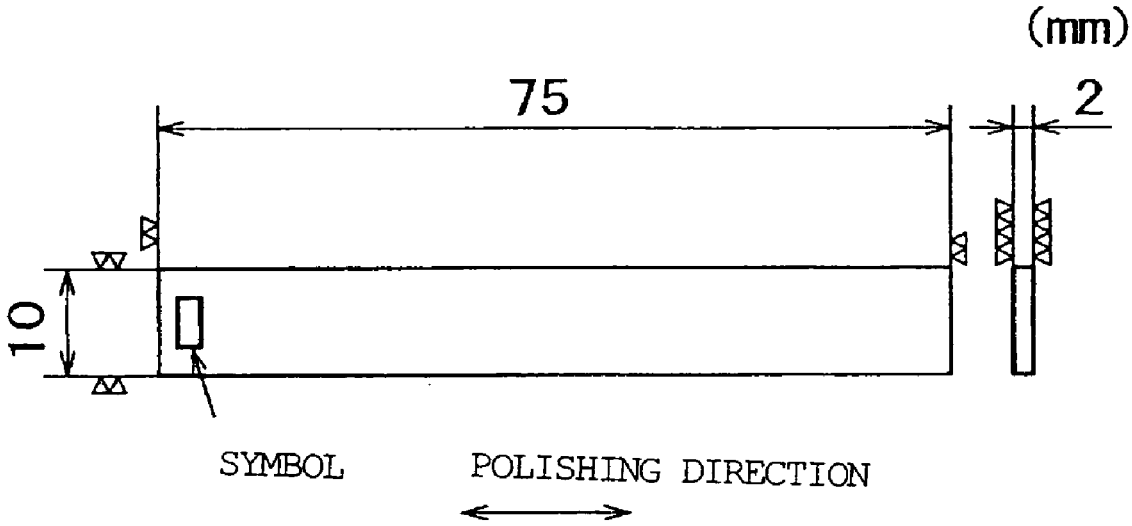
FIG. 1(*a*) is a view showing a rectangular test piece prepared in example, and FIG. 1(*b*) is a view showing a jig used for a stress corrosion crack test, to which the test piece, whose surface has been polished with emery paper, is installed.
Figure 1:
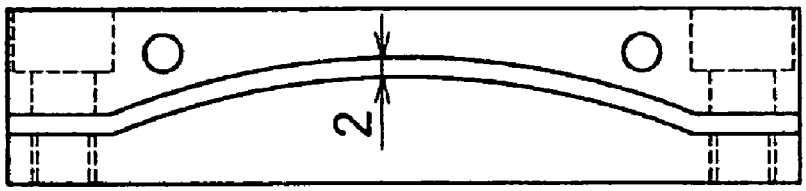

An austenitic stainless steel in accordance with the present invention is one in which the contents of C, Si, Mn, P, S, Ni, Cr, Mo and N are specified in percent by weight, and the balance substantially consists of Fe and unavoidable impurities.

Now, the role of each element in the alloy is explained.

C is an element indispensable to obtain a predetermined strength and to stabilize austenite in an austenitic stainless steel. It is well known that if C is heated at temperatures of 400 to 900° C. or cooled slowly in this temperature range, Cr carbide deposits at the grain boundary, and a Cr depletion layer is produced around the deposit, and sensitization such that the grain boundary becomes sensitive to corrosion occurs. To restrain the sensitization, the C content is generally set at 0.03% or lower.

If the C content is 0.03% or lower, the strength is insufficient, and also the stability of austenite is insufficient. Conventionally, therefore, N, which is an important element for obtaining the strength of austenitic stainless steel and for stabilizing austenite like C, has been added to ensure strength and stabilize austenite. However, the inventors paid attention to the fact that if the N content increases, the steel is easily hardened when working distortion or heat distortion is applied, and if the steel is affected by heat, Cr nitride deposits and the Cr content in the crystal matrix decreases, so that corrosion cracking is rather liable to occur. In the present invention, the N content was decreased by overturning the conventionally accepted practice. It was thought that it is desirable to decrease the N content to a level such that it can be decreased stably in industrial terms, and the N content was set at 0.01% or lower.

In the manufacturing process of austenitic stainless steel, Si plays an important role as a deoxidizer, and usually an austenitic stainless steel contains about 0.5% of Si. However, the inventors paid attention to the fact that the Si content of about 0.5% makes the steel easy to harden when working distortion or heat distortion is applied. In the present invention, it was thought that it is desirable to decrease the Si content as far as possible in the range such that it can be decreased stably in industrial terms, and the Si content was set at 0.1% or lower, preferably 0.02% or lower.

Cr and Mo are known as very important elements in keeping the corrosion resistance of austenitic stainless steel. However, Cr and Mo are ferrite generating elements, so that it is known that if the contents of Cr and Mo are increased too much, the stability of austenite deteriorates, and also the ductility thereof decreases, thereby deteriorating the workability. Conventionally, therefore, the contents of Cr and Mo have not been increased extremely. By contrast, the inventors decreased the contents of C, N and Si as far as possible to improve the stress corrosion crack resistance. Thereby, at the same time, the ductility of austenitic stainless steel could be increased. To cope with the problem that the stability of austenite deteriorates as a consequence of the increase in the contents of Cr and Mo and the as-much-as-possible decrease in the contents of C and N, the contents of Ni and Mn were increased, by which the inventors succeeded in maintaining the stability of austenite.

Also, a problem in that a predetermined strength level becomes insufficient due to the as-much-as-possible decrease in the contents of C and N was solved by balancing the contents of C, N, Si, Ni, Cr, Mo and Mn.

In the steel making process of austenitic stainless steel, CaF, CaO, or metal Ca is generally used for desulfurization. Ca for this purpose remains in the steel. It is known that this Ca sometimes segregates at the grain boundary, and there is a fear of decreasing the intergranular corrosion resistance. In the present invention, therefore, it is preferable that carefully selected raw materials be used, and in the steel making process of austenitic stainless steel, CaF, CaO, or metal Ca be not used as far as possible for desulfurization to prevent Ca from segregating at the grain boundary.

Also, though very rarely, Mg is sometimes added to the austenitic stainless steel to improve hot workability. However, it is known that this Mg also segregates at the grain boundary, and thus there is a fear of decreased intergranular corrosion resistance. In the present invention, therefore, it is preferable that carefully selected raw materials of Mg be used to prevent mixing of Mg as far as possible, thereby preventing the intergranular corrosion resistance from decreasing.

Zr, B and Hf are well known as elements segregating at the grain boundary, and have conventionally been said to be elements that should not be used for corrosion resistant austenitic stainless steel for nuclear power because intergranular corrosion becomes liable to occur due to the segregation of Zr, B and Hf, whereby nuclear transformation occurs and the neutron absorbing cross-sectional area is large when B and Hf receive neutron irradiation. In the present invention, however, because of the austenitic stainless steel in which the contents of C, N and Si are decreased as far as possible, even if a small amount of 0.01% or less of Zr, B and Hf is added, the stress corrosion crack propagation velocity in high-temperature and pressure water can be decreased significantly without decreasing the intergranular corrosion resistance of austenitic stainless steel.

An austenitic stainless steel is generally used in a state of being solution treated while avoiding sensitization. However, the inventors obtained knowledge that if Cr carbide depositing in harmonization with the crystal matrix is deposited at the grain boundary of austenitic stainless steel, the stress corrosion crack propagation velocity in high-temperature and pressure water can be decreased significantly. Therefore, in the manufacturing method in accordance with the present invention, to positively deposit Cr carbide depositing in harmonization with the crystal matrix, it is preferable that Cr carbide precipitation treatment at 600 to 800° C. for 1 to 50 hours be performed after 10 to 30% cold working has been performed after solution heat treatment.

The above-described austenitic stainless steel can be used suitably, for example, especially as a pipe or an in-furnace structure for a nuclear reactor. Also, the stainless steel obtained by the above-described manufacturing method can also be used suitably as a component material for a pipe or an in-furnace structure for a nuclear reactor.

Figure 12:
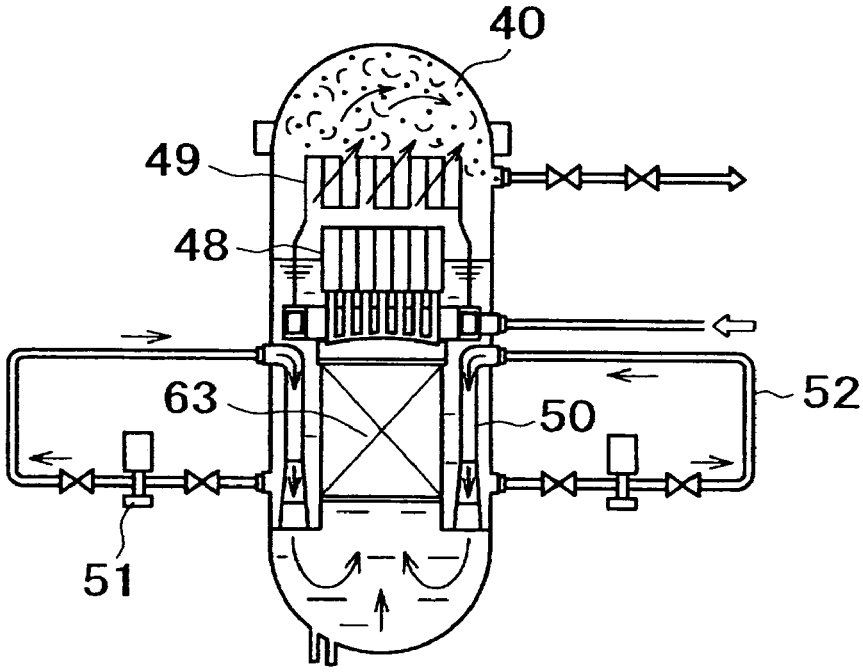
FIG. 12(*a*) is an explanatory view of an essential portion of a boiling water reactor, and FIG. 12(*b*) is an explanatory view of an essential portion of a pressurized water reactor.
Figure 12:
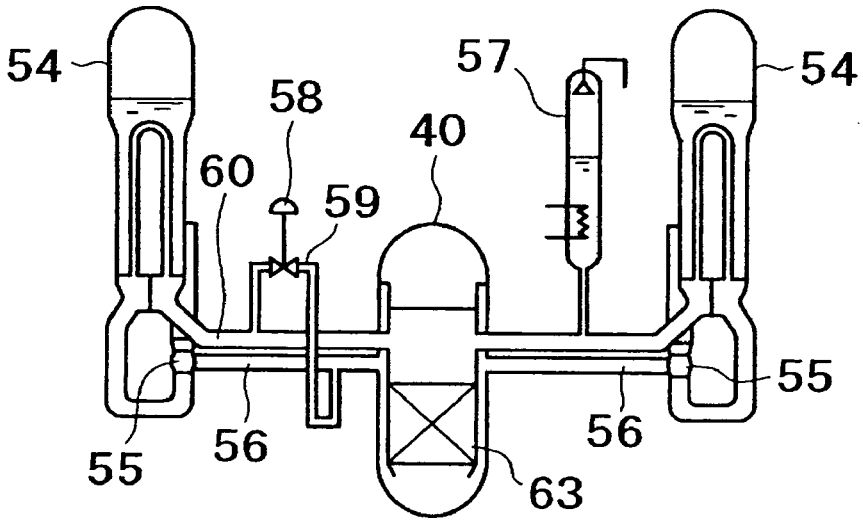
Figure 13:
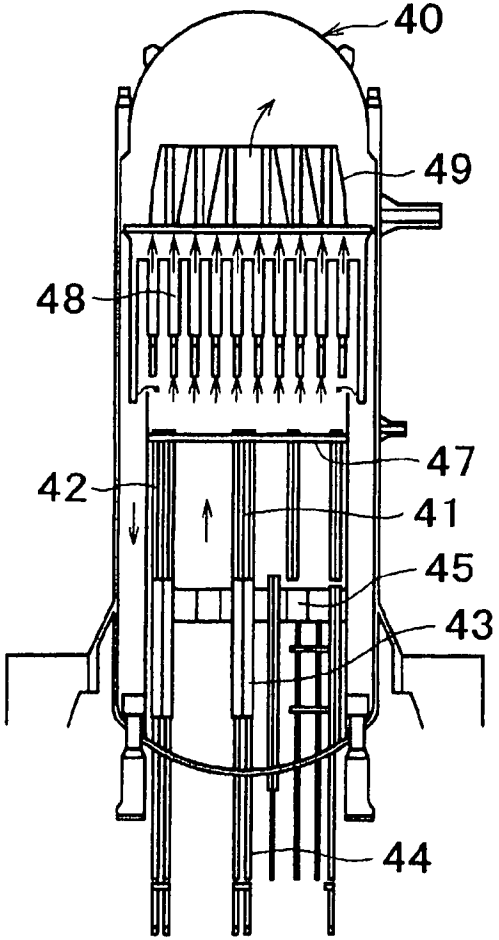
FIG. 13 illustrates two longitudinal sectional views showing the internal construction of the reactors shown in FIG. 12.
Figure 13:
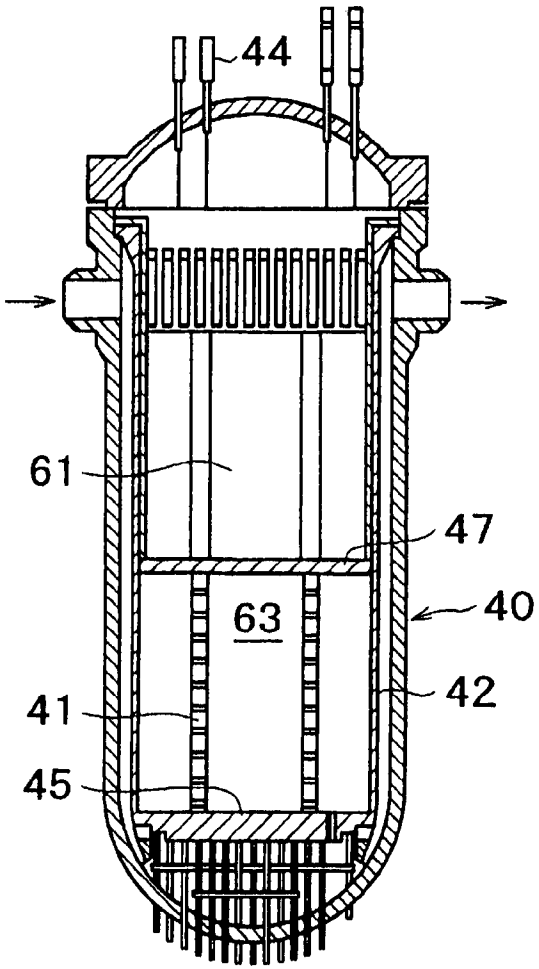

FIGS. 12(*a*) and 12(*b*) are explanatory views of essential portions of a boiling water reactor and a pressurized water reactor, respectively, and FIGS. 13(*a*) and 13(*b*) are longitudinal sectional views showing the internal constructions of the respective reactors shown in FIG. 12.

In FIG. 13, in a reactor pressure vessel 40, a fuel assembly (fuel rod) 41 for producing nuclear reaction is provided on the inside of a core shroud 42, and a control rod guide tube or a control rod driving mechanism 44 is provided below or above the fuel assembly 41. These pieces of equipment are fixed by a core support plate 45 and a fuel support member. Further, the uppermost part of the fuel assembly 41 is fixed by an upper support plate 47.

In the boiling water reactor shown in FIGS. 12(*a*) and 13(*a*), in order to take out only steam from a gas-liquid two-phase flow boiled and generated by the fuel assembly 41 to the upper part of the core, a steam separator 48 is provided, and further a steam dryer 49 is provided above the steam separator 48. Also, apart from a main steam-water system, an external recirculation circuit 52 in which a jet pump 50 and a recirculation pump 51 are combined is formed.

Also, in the pressurized water reactor shown in FIGS. 12(*b*) and 13(*b*), hot water heated by the fuel assembly 41 is supplied to a steam generator 54 through a high temperature-side pipe 53. The hot water is cooled by heat exchange using the steam generator 54, and is returned into the reactor pressure vessel 40 through a low temperature-side pipe 56 via a primary coolant pump 55. Also, the low temperature-side pipe 56 and the high temperature-side pipe 53 are connected to each other via a bypass pipe 59 having an on-off valve 58.

By using the austenitic stainless steel in accordance with the present invention to manufacture the component members, such as various pipes and pumps, constituting the systems, circulation circuits, etc. or in-furnace structures such as the core shroud 42, the core support plate 45, the upper support plate 47, etc. of the above-described reactors, a stress corrosion crack is less liable to develop even in a high-temperature and pressure water environment, so that the reactor component members can be used for a long period of time. Also, if the stress corrosion crack develops, the stress corrosion crack is less liable to propagate, so that a remarkable effect can be achieved in improving safety and reliability of the nuclear power plant.

Hereunder, the present invention will be explained in more detail by using an example. The present invention is not subjected to any restriction by this example.

EXAMPLE

Table 1 gives compositions of conventional SUS 316L (comparative material 1) and 316NG (comparative material 2) widely used as a nuclear power material, and test materials 1 to 28 having chemical components (the content is expressed in percent by weight) in accordance with the present invention.

Table 2 gives working and heat treatment conditions for the test materials given in Table 1.

[Table 1]

TABLE 1

Target chemical composition, melting method, and working and heat treatment method of test melted material

| | | Chemical component (Wt %) | | | | | | | | | | Ni equiv- | Cr equiv- |
|---|---|---|---|---|---|---|---|---|---|---|---|---|---|
| Material No. | Purpose | C | N | Si | Mn | P | S | Ni | Cr | Mo | Others | alent | alent |
| Comparative example 1 | Conventional material (SUS316L) | ≦0.030 | — | ≦1.0 | ≦2.0 | ≦0.045 | ≦0.030 | from 12.0 to 15.0 | from 16.00 to 18.00 | from 2.00 to 3.00 | — | | |
| Comparative example 2 | Conventional material (316NG) | ≦0.030 | from 0.08 to 0.15 | ≦1.0 | ≦2.0 | ≦0.045 | ≦0.030 | from 12.0 to 15.0 | from 16.00 to 18.00 | from 2.00 to 3.00 | — | | |
| Test material 1 | SUS316L test material | 0.0191 | 0.03 | 0.52 | 0.83 | 0.023 | 0.002 | 12.4 | 16.4 | 2.32 | | 14.3 | 19.5 |
| Test material 2 | 316NG test material | 0.0192 | 0.095 | 0.53 | 0.84 | 0.024 | 0.001 | 12.5 | 16.5 | 2.31 | | 16.3 | 19.6 |
| Test material 3 | Influence of Cr content and SFE | 0.0191 | 0.087 | 0.51 | 0.81 | 0.026 | 0.001 | 12.3 | 18.1 | 2.33 | | 15.9 | 21.2 |
| Test material 4 | Influence of Cr content and SFE | 0.0194 | 0.101 | 0.54 | 0.82 | 0.025 | 0.001 | 12.2 | 20.2 | 2.34 | | 16.2 | 23.4 |
| Test material 5 | Influence of Cr content and SFE | 0.0193 | 0.095 | 0.55 | 0.83 | 0.023 | 0.001 | 12.4 | 25.3 | 2.30 | | 16.2 | 28.4 |
| Test material 6 | Influence of Cr equivalent, Ni equivalent, and SFE | 0.0195 | 0.102 | 0.52 | 0.88 | 0.022 | 0.002 | 19.1 | 25.2 | 2.31 | | 23.2 | 28.3 |
| Test material 7 | Influence of Cr equivalent, Ni equivalent, and SFE | 0.0193 | 0.101 | 0.53 | 0.82 | 0.021 | 0.001 | 15.2 | 23.4 | 2.32 | | 19.2 | 26.5 |

TABLE 1-continued

Target chemical composition, melting method, and working and heat treatment method of test melted material

| Material No. | Purpose | Chemical component (Wt %) | | | | | | | | | | Ni equiv- | Cr equiv- |
|---|---|---|---|---|---|---|---|---|---|---|---|---|---|
| | | C | N | Si | Mn | P | S | Ni | Cr | Mo | Others | alent | alent |
| Test material 8 | Influence of Si content and SFE | 0.0192 | 0.102 | 0.22 | 0.81 | 0.025 | 0.001 | 12.5 | 16.5 | 2.33 | | 16.5 | 19.2 |
| Test material 9 | Influence of Si content and SFE | 0.0194 | 0.101 | 0.10 | 0.83 | 0.022 | 0.002 | 12.4 | 16.4 | 2.34 | | 16.4 | 18.9 |
| Test material 10 | Influence of Si content and SFE | 0.0195 | 0.101 | ≦0.02 | 0.82 | 0.024 | 0.001 | 12.3 | 16.7 | 2.32 | | 16.3 | 19.1 |
| Test material 11 | Influence of trace element | 0.0193 | 0.095 | 0.53 | 0.81 | 0.026 | 0.002 | 12.2 | 16.8 | 2.31 | 0.02Mg | 16.0 | 19.9 |
| Test material 12 | Influence of trace element | 0.0194 | 0.101 | 0.52 | 0.82 | 0.027 | 0.001 | 12.5 | 16.1 | 2.33 | 0.009Zr | 16.5 | 19.2 |
| Test material 13 | Influence of trace element | 0.0192 | 0.102 | 0.51 | 0.84 | 0.026 | 0.002 | 12.5 | 16.3 | 2.32 | 0.005Ca | 16.6 | 19.4 |
| Test material 14 | Influence of trace element | 0.0193 | 0.103 | 0.53 | 0.82 | 0.025 | 0.001 | 12.6 | 16.4 | 2.31 | 0.006O | 16.7 | 19.5 |
| Test material 15 | Influence of trace element | 0.0192 | 0.102 | 0.52 | 0.81 | 0.022 | 0.002 | 12.7 | 16.5 | 2.33 | 0.009B | 16.7 | 19.6 |
| Test material 16 | Influence of trace element | 0.0191 | 0.101 | 0.54 | 0.83 | 0.023 | 0.001 | 12.8 | 16.7 | 2.32 | 0.20Al | 16.8 | 19.8 |
| Test material 17 | Influence of trace element | 0.0194 | 0.102 | 0.52 | 0.81 | 0.026 | 0.002 | 12.9 | 16.4 | 2.33 | 0.20Ti | 16.9 | 19.5 |
| Test material 18 | Influence of trace element | 0.0193 | 0.103 | 0.53 | 0.83 | 0.024 | 0.001 | 12.3 | 16.5 | 2.31 | 0.20V | 16.4 | 19.6 |
| Test material 19 | Influence of trace element | 0.0192 | 0.095 | 0.51 | 0.85 | 0.025 | 0.002 | 12.5 | 16.3 | 2.34 | 0.009Hf | 16.4 | 19.4 |
| Test material 20 | Influence of Ni equivalent, Cr equivalent, and SFE | 0.0191 | 0.098 | 0.50 | 0.82 | 0.026 | 0.001 | 15.0 | 16.4 | 2.32 | | 18.9 | 19.5 |
| Test material 21 | Influence of Ni equivalent, Cr equivalent, and SFE | 0.0193 | 0.003 | ≦0.02 | 0.81 | 0.025 | 0.002 | 11.0 | 18.2 | 2.31 | | 12.1 | 20.5 |
| Test material 22 | Influence of Ni equivalent, Cr equivalent, and SFE | 0.0194 | 0.101 | 0.52 | 2.0 | 0.023 | 0.001 | 10.1 | 16.3 | 2.33 | | 14.7 | 19.4 |
| Test material 23 | Influence of Ni equivalent, Cr equivalent, and SFE | 0.0191 | 0.102 | 0.53 | ≦0.03 | 0.022 | 0.002 | 12.5 | 16.4 | 2.32 | | 16.1 | 19.5 |
| Test material 24 | Influence of Mo content and SFE | 0.0193 | 0.102 | 0.51 | 0.83 | 0.024 | 0.001 | 12.6 | 16.5 | 1.01 | | 16.7 | 18.3 |
| Test material 25 | Influence of Ni equivalent, Cr equivalent, Mo equivalent, and SFE | 0.0192 | 0.003 | ≦0.02 | 0.81 | 0.025 | 0.001 | 15.1 | 23.2 | 1.03 | | 16.2 | 24.3 |
| Test material 26 | Influence of Ni equivalent, Cr equivalent, and SFE | 0.0191 | 0.003 | ≦0.02 | 0.85 | 0.026 | 0.001 | 25.2 | 23.1 | 2.34 | | 26.3 | 25.5 |
| Test material 27 | Influence of Ni equivalent, Cr equivalent, and SFE | 0.0194 | 0.003 | ≦0.02 | 0.82 | 0.028 | 0.001 | 20.1 | 25.1 | 2.33 | | 21.2 | 27.5 |
| Test material 28 | Influence of SFE | 0.0194 | 0.003 | 0.52 | 0.81 | 0.027 | 0.001 | 12.5 | 16.4 | 2.32 | | 13.6 | 19.5 |

TABLE 2

| Working and heat treatment conditions | | | | |
|---|---|---|---|---|
| | Hot working | Solution heat treatment | Cold working | Precipitation Treatment |
| Condition 1 | 950 to 1250° C., working ratio of 20% or higher | Held at 1000 to 1150° C. for 30 min/25 mm or more, then water cooled | | |
| Condition 2 | 950 to 1250° C., working ratio of 20% or higher | Held at 1000 to 1150° C. for 30 min/25 mm or more, then water cooled | Room temperature to 250° C., working ratio of 10 to 30% | Heat treatment at 600 to 800° C. for 1 to 50 hr, then air cooled |

For the test materials 1 to 28 given in Table 1, a rectangular test piece measuring 2 mm thick, 20 mm wide, and 50 mm long was prepared, a boiling test of continuous 16 hours was conducted in conformity with JIS G0575 "Method of Copper Sulfate-Sulfuric Acid Test for Stainless Steels", and a bending test with a bend radius of 1 mm was conducted to examine the presence of cracks. The results are given in Table 3.

TABLE 3

| Bending test results after copper sulfate-sulfuric acid test | |
|---|---|
| Material No. | Bending test result |
| Test material 1 | ○ |
| Test material 2 | ○ |
| Test material 3 | ○ |
| Test material 4 | ○ |
| Test material 5 | ○ |
| Test material 6 | ○ |
| Test material 7 | ○ |
| Test material 8 | ○ |
| Test material 9 | ○ |
| Test material 10 | ○ |
| Test material 11 | ○ |
| Test material 12 | ○ |
| Test material 13 | ○ |
| Test material 14 | ○ |
| Test material 15 | ○ |
| Test material 16 | ○ |
| Test material 17 | ○ |
| Test material 18 | ○ |
| Test material 19 | ○ |
| Test material 20 | ○ |
| Test material 21 | ○ |
| Test material 22 | ○ |
| Test material 23 | ○ |
| Test material 24 | ○ |
| Test material 25 | ○ |
| Test material 26 | ○ |
| Test material 27 | ○ |
| Test material 28 | ○ |

○: No crack

Figure 2:
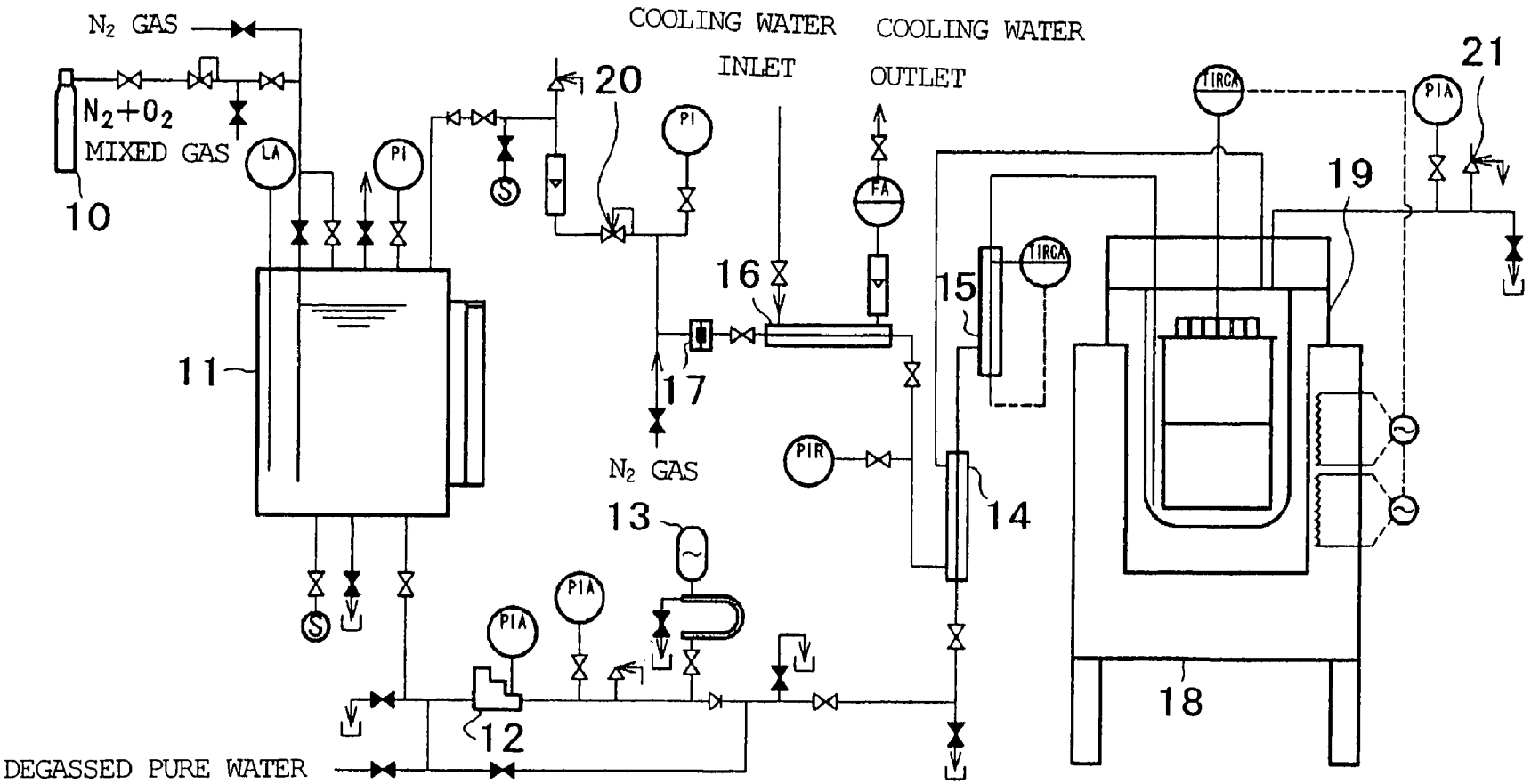
FIG. 2 is a view showing a configuration of a system of a circulating autoclave for a stress corrosion crack test used in the example.

A test piece having a shape shown in FIG. 1 was prepared from the test material given in Table 1. This test piece was subjected to a stress corrosion crack developing test of 3000 hours in an autoclave shown in FIG. 2 under the test conditions given in Table 4. In the circulating autoclave for stress corrosion crack test shown in FIG. 2, water quality is regulated by a makeup water tank 11, and water is degassed by $N_2$ gas. Thereafter, high-temperature and pressure water is sent to the autoclave, which is a test vessel 19, through a preheater 15 by a high-pressure metering pump 12, and some of the high-temperature and pressure water is circulated. At the front stage of the preheater 15, a heat exchanger 14 to which a cooler 16 is connected is provided. The test vessel 19 is covered with an electric furnace 18.

FIGS. 3 to 8 show the outline of result by plotting maximum crack length as a function of the contents of component elements (Cr, Si, N), (Cr equivalent)−(Ni equivalent), Cr equivalent/Ni equivalent, and stacking fault energy, respectively.

Figure 3:
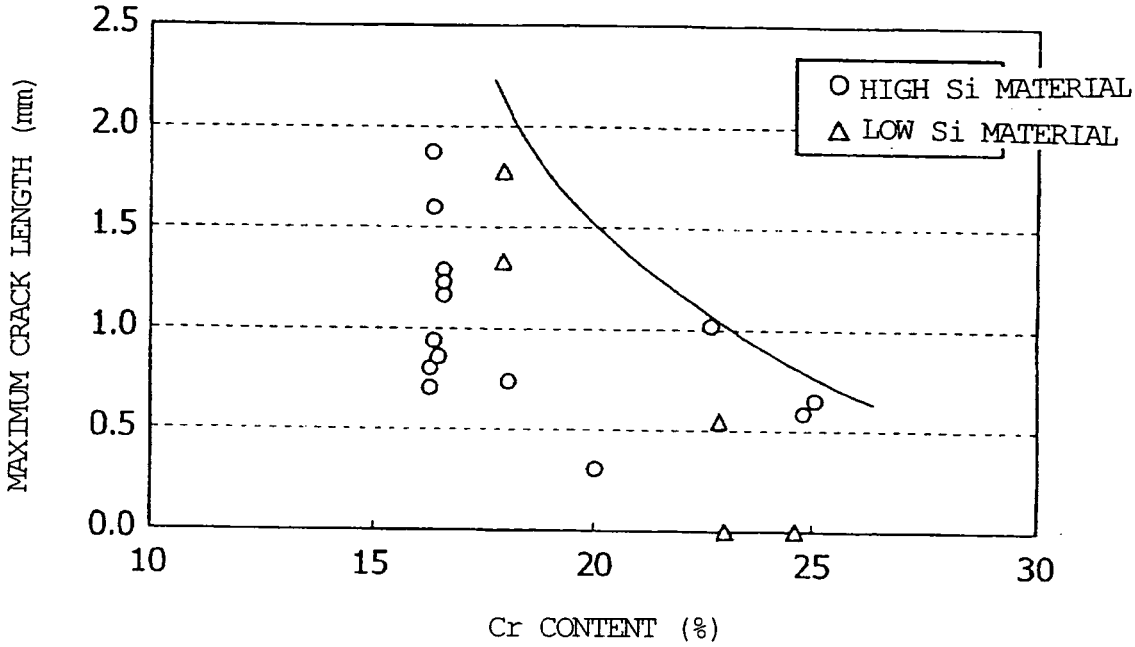
FIG. 3 is a diagram in which stress corrosion crack lengths are plotted as a function of Cr content, in which the maximum crack lengths are plotted.

FIG. 3 shows the influence of Cr content exerted on the stress corrosion crack resistance of Mo-containing austenitic stainless steel. As the Cr content increased, the stress corrosion crack resistance of Mo-containing austenitic stainless steel was improved.

Figure 4:
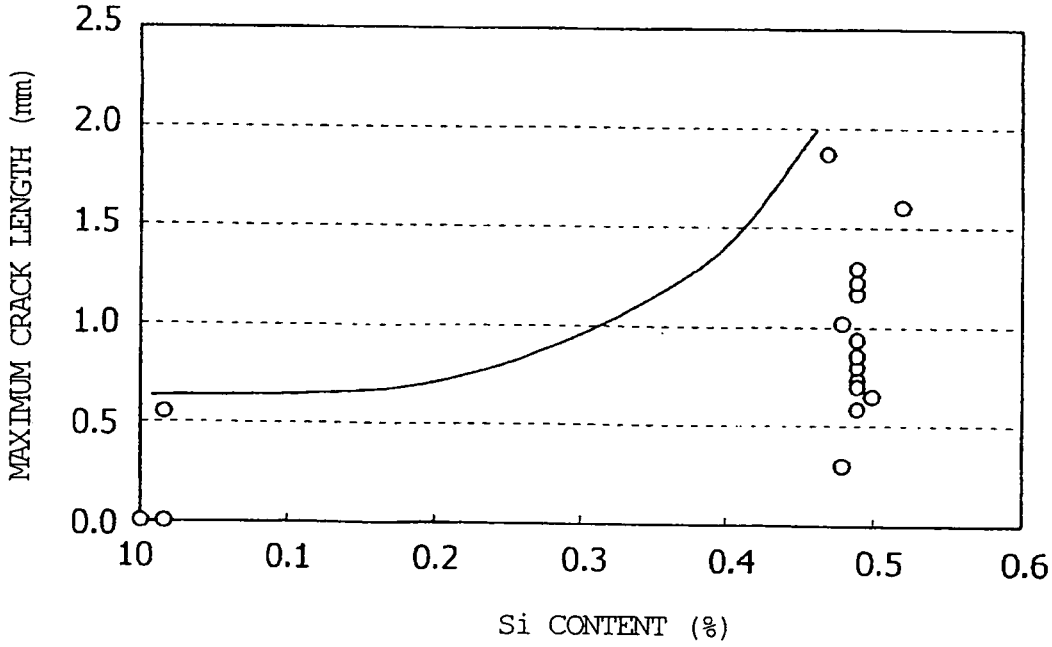
FIG. 4 is a diagram in which stress corrosion crack lengths are plotted as a function of Si content, in which the maximum crack lengths are plotted.

FIG. 4 shows the influence of Si content exerted on the stress corrosion crack resistance of Mo-containing austenitic stainless steel. As the Si content decreased, the stress corrosion crack length became shorter, and thus the stress corrosion crack resistance of Mo-containing austenitic stainless steel was improved.

Figure 5:
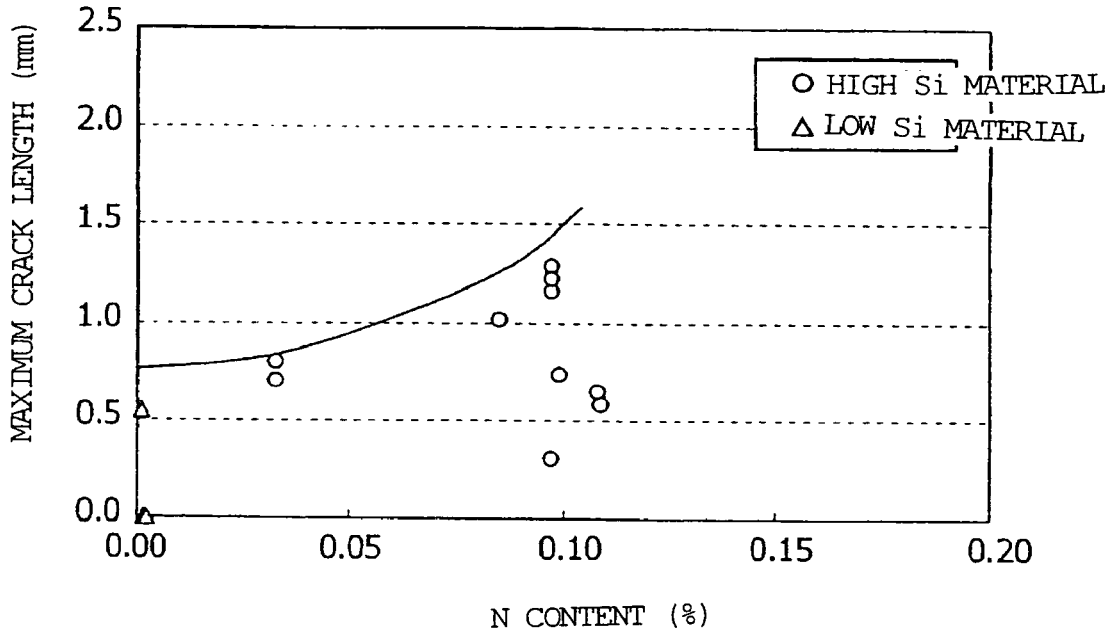
FIG. 5 is a diagram in which stress corrosion crack lengths are plotted as a function of N content, in which the maximum crack lengths are plotted.

FIG. 5 shows the influence of N content exerted on the stress corrosion crack resistance of Mo-containing austenitic stainless steel. As the N content decreased, the stress corrosion crack length became shorter, and thus the stress corrosion crack resistance of Mo-containing austenitic stainless steel was improved.

Figure 6:
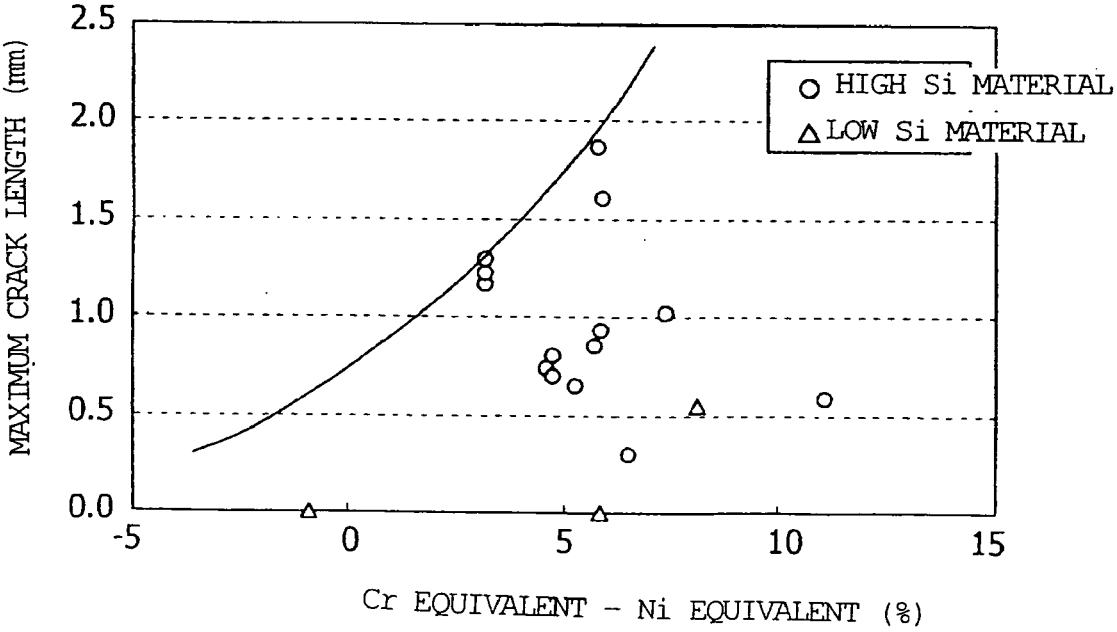
FIG. 6 is a diagram in which stress corrosion crack lengths are plotted as a function of (Cr equivalent)−(Ni equivalent), in which the maximum crack lengths are plotted.

FIG. 6 shows the influence of (Cr equivalent)−(Ni equivalent) exerted on the stress corrosion crack resistance of Mo-containing austenitic stainless steel. As the value of (Cr equivalent)−(Ni equivalent) increased, the stress corrosion crack length became shorter, and thus the stress corrosion crack resistance of Mo-containing austenitic stainless steel was improved. However, the stress corrosion crack resistance peaked at a specific value, and if the value of (Cr equivalent)−(Ni equivalent) increased further, the stress corrosion crack resistance decreased.

Figure 7:
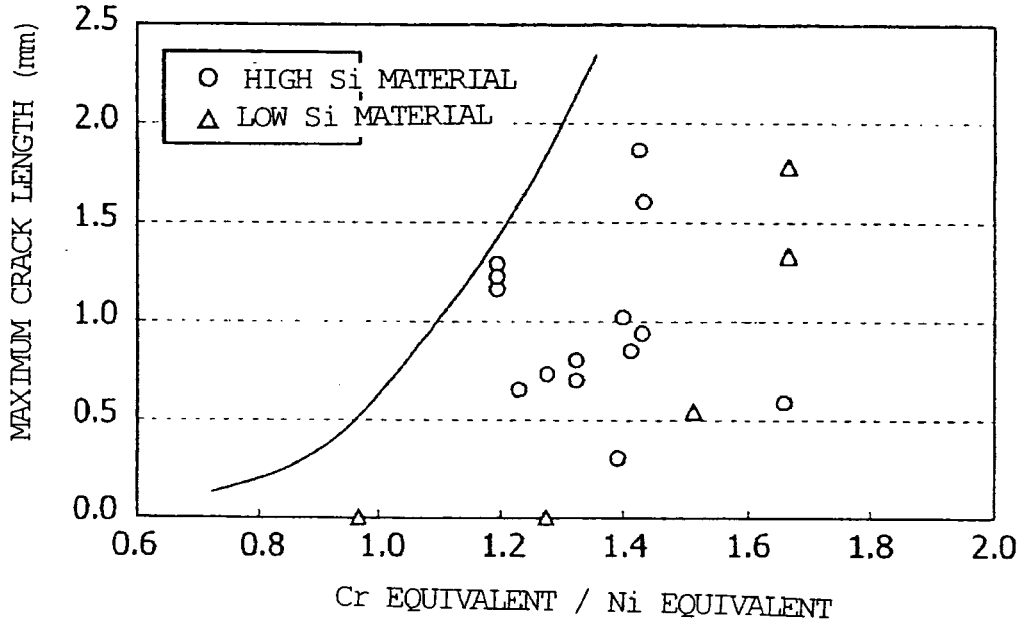
FIG. 7 is a diagram in which stress corrosion crack lengths are plotted as a function of Cr equivalent/Ni equivalent, in which the maximum crack lengths are plotted.

FIG. 7 shows the influence of Cr equivalent/Ni equivalent exerted on the stress corrosion crack resistance of Mo-containing austenitic stainless steel. As the ratio of Cr equivalent/Ni equivalent decreased, the stress corrosion crack length became shorter, and thus the stress corrosion crack resistance of Mo-containing austenitic stainless steel was improved.

Figure 8:
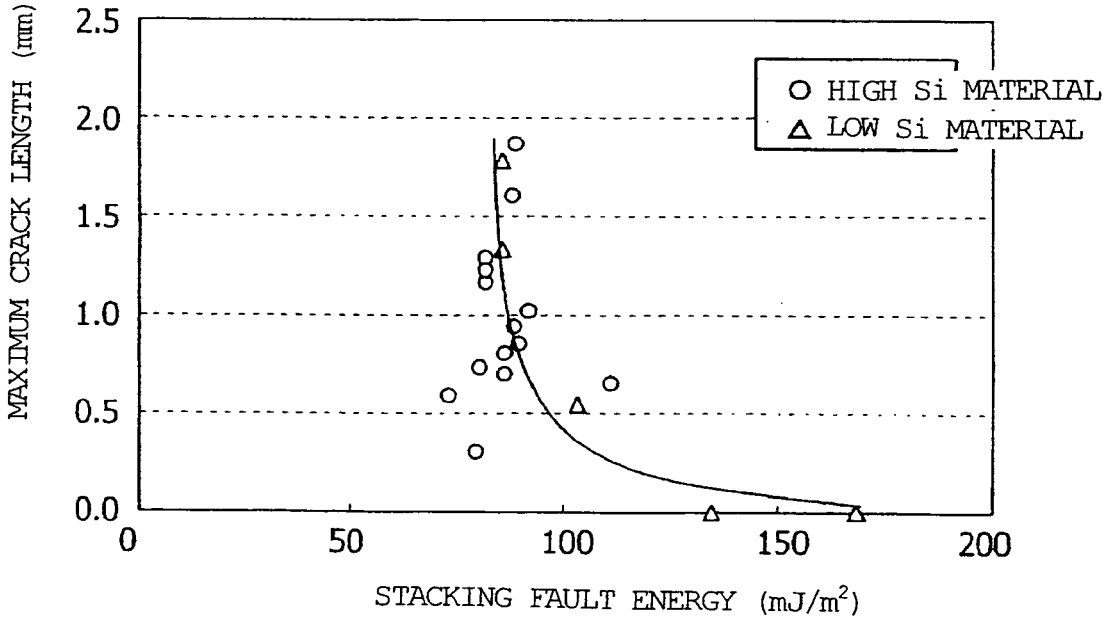
FIG. 8 is a diagram in which stress corrosion crack lengths are plotted as a function of stacking fault energy, in which the maximum crack lengths are plotted.

FIG. 8 shows the influence of stacking fault energy (a value calculated by the following equation (1)) exerted on the stress corrosion crack resistance of Mo-containing austenitic stainless steel (maximum crack length).

$$SFE(mJ/m^2)=25.7+6.2\times Ni+410\times C-0.9\times Cr-77\times N-13\times Si-1.2\times Mn \quad (1)$$

As the stacking fault energy increased, the stress corrosion crack length became shorter, and thus the stress corrosion crack resistance of Mo-containing austenitic stainless steel was improved. In particular, it was found that when the stacking fault energy is ($mJ/m^2$) or higher, an especially excellent property is provided.

TABLE 4

| Test conditions | | |
|---|---|---|
| Item | Unit | Test condition |
| Corrosion potential | mV | 200 |
| | | $H_2O_2$ concentration, regulated by dissolved oxygen concentration |
| Electric conductivity | μS/cm | 0.3 |
| pH (25 C. °) | | 6.5 |
| Temperature | C. ° | 288 |
| Cl concentration | Ppb | 20 |

It was found that if the alloy contains 17% or more, preferably 20% or more, of Cr content, 0.01% or less of N content, and 0.1% or less, preferably 0.02% or less, of Si content in accordance with the present invention, stress corrosion crack generation shifts significantly to the long life side.

Figure 9:
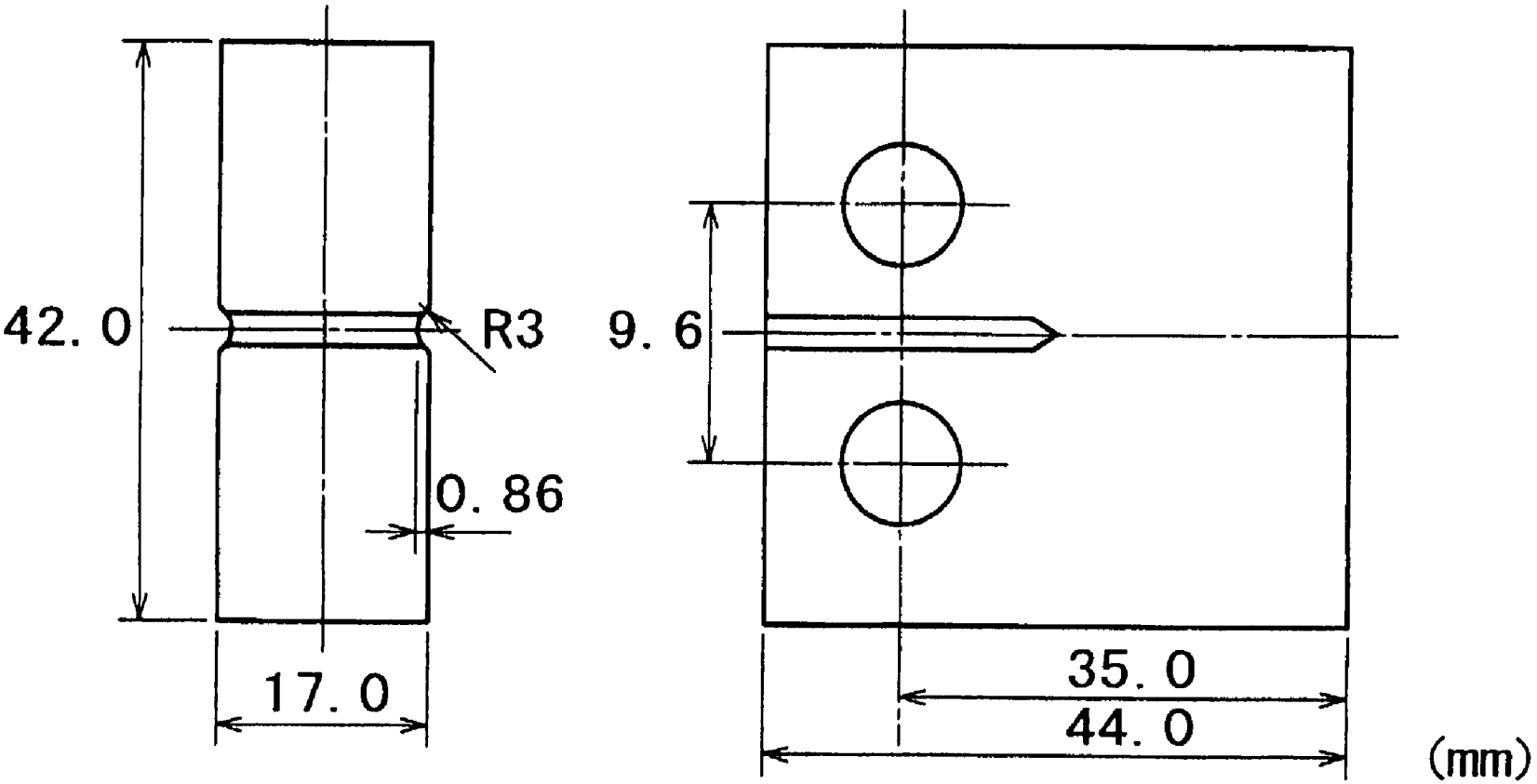
FIG. 9 is a view showing a shape of a CT test piece for a stress corrosion crack propagation test used in the example.
Figure 10:
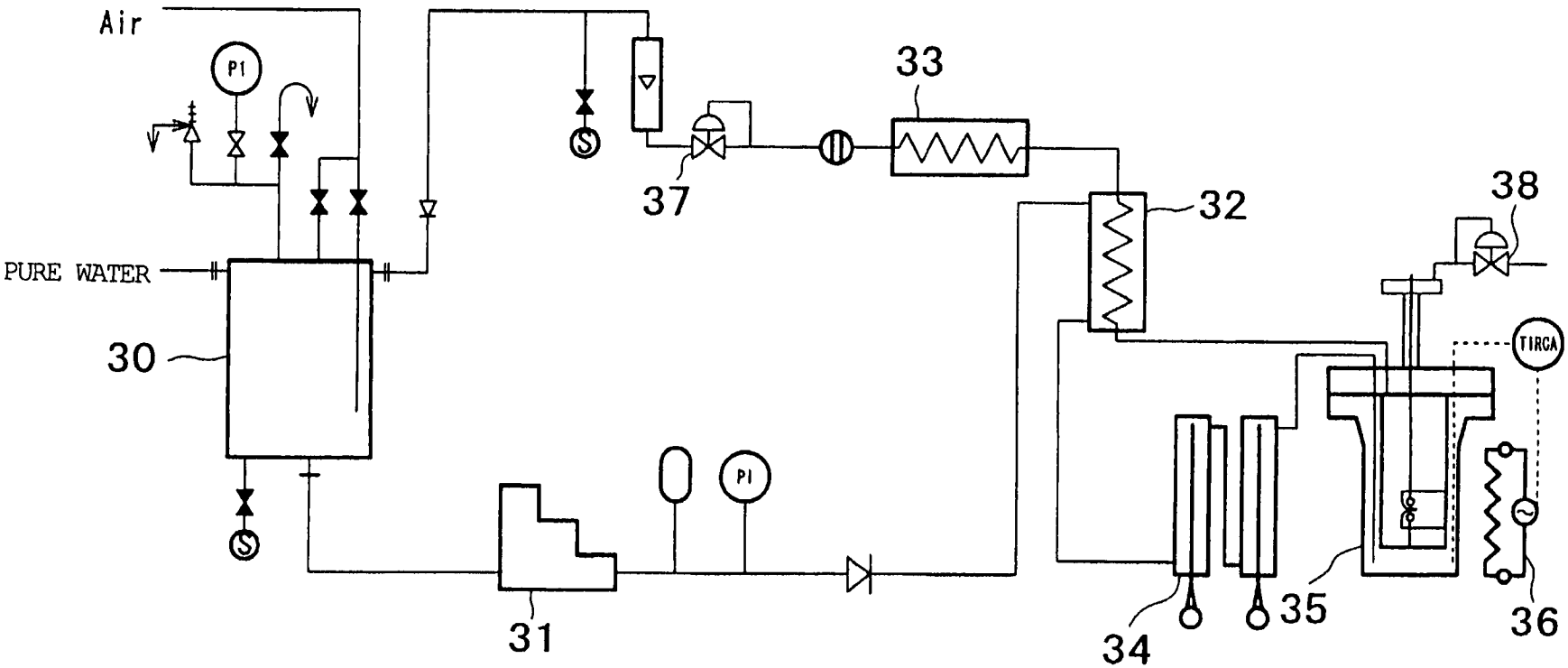
FIG. 10 is a view showing a configuration of a system of a circulating autoclave for a stress corrosion crack propagation test used in the example.

Furthermore, a test piece having a shape shown in FIG. 9 was prepared from the test materials given in Table 1. This test piece was subjected to a stress corrosion crack propagation test in an autoclave shown in FIG. 10 under the test conditions given in Table 5. In the circulating autoclave for stress corrosion crack propagation test shown in FIG. 10, water quality is regulated by a makeup water tank 30, and water is degassed by $N_2$ gas. Thereafter, high-temperature and pressure water is sent to the autoclave, which is a test vessel 35, through a preheater 34 by a high-pressure metering pump (makeup water pump) 31, and some of the high-temperature and pressure water is circulated. At the front stage of the preheater 34, a heat exchanger 32 to which a cooler 33 is connected is provided. In the vicinity of the test vessel 35, a heater 36 is provided.

Figure 11:
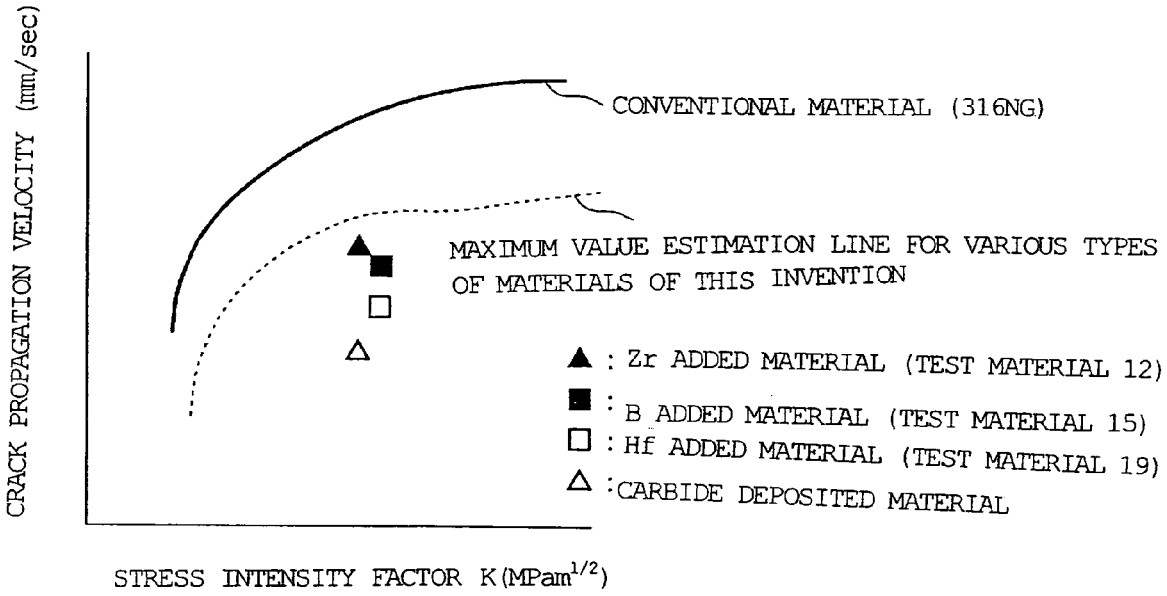
FIG. 11 is a graph showing the influence of Zr addition, B addition, Hf addition, and intergranular carbide precipitation treatment exerted on a stress corrosion crack propagation velocity of a Mo-containing austenitic stainless steel.

FIG. 11 shows the results of the test materials 12, 15 and 19 and a carbide deposited material, together with the conventional material (316NG), to investigate the influence of Zr addition, B addition, Hf addition, and intergranular carbide precipitation treatment exerted on the stress corrosion crack propagation velocity of Mo-containing austenitic stainless steel. It was found that if the Zr addition, B addition, Hf addition, intergranular carbide precipitation treatment, etc. were carried out, the stress corrosion crack propagation velocity became low as compared with the conventional material, and thus the stress corrosion crack resistance of Mo-containing austenitic stainless steel was improved.

TABLE 5

| | Item | Unit | Test condition |
|---|---|---|---|
| Water quality condition | Corrosion potential | mV | 200 |
| | | | $H_2O_2$ concentration, regulated by dissolved oxygen concentration |
| | Electric conductivity | μS/cm | 0.3 |
| | pH (25 C. °) | | 6.5 |
| | Temperature | ° C. | 288 |
| | Cl concentration | Ppb | 20 |
| | $H_2O_2$ concentration | ppm | |
| stress load condition | Waveform | | Trapezoidal waveform |
| | Load relieving ratio | | 30% (R = 0.7) |
| | holding time at maximum load stress | hour | 30 |

Industrial Applicability

The austenitic stainless steel in accordance with the present invention is less liable to sensitize, has high stress corrosion crack resistance, and is configured so that even if a stress corrosion crack is generated, the stress corrosion crack is less liable to propagate. Therefore, this austenitic stainless steel is especially suitable as a component material for various pipes and in-furnace structures of a nuclear reactor operated in a high-temperature and pressure water environment. From the viewpoint of safety and reliability of nuclear power plant, this austenitic stainless steel is very significant in industrial terms.

The invention claimed is:

1. An austenitic stainless steel having high stress corrosion crack resistance, containing, in percent by weight, 0.030% or less C,
0.02% or less Si,
0.85% or less Mn,
0.03% or less P,
0.002% or less S,
11 to 20.1% Ni,
17 to 30% Cr,
1.03 to 3% Mo, and
0.003% or less N, the balance substantially being Fe and unavoidable impurities, and having stacking fault energy (SFE) calculated by the following equation (1):

$$\text{SFE (mJ/m}^2\text{)}=25.7+6.2\times\text{Ni}+410\times\text{C}-0.9\times\text{Cr}-77\times\text{N}-13\times\text{Si}-1.2\times\text{Mn} \quad (1)$$

that is 100 (mJ/m$^2$) or higher.

2. The austenitic stainless steel having high stress corrosion crack resistance according to claim 1, wherein (Cr equivalent)−(Ni equivalent) is in the range of −5% to +7%.

3. The austenitic stainless steel having high stress corrosion crack resistance according to claim 1, wherein Cr equivalent/Ni equivalent is 0.7 to 1.4.

4. A manufacturing method for a stainless steel, wherein a billet consisting of the austenitic stainless steel according to claim 1 is subjected to solution heat treatment at a temperature of 1000 to 1150 degrees C.

5. A manufacturing method for a stainless steel, wherein a billet consisting of the austenitic stainless steel according to claim 1 is subjected to solution heat treatment at a temperature of 1000 to 1150 degrees C., thereafter is subjected to cold working of 10 to 30%, and is then subjected to intergranular carbide precipitation treatment at a temperature of 600 to 800° C. for 1 to 50 hours.

6. A structure in a nuclear reactor, formed of the austenitic stainless steel according to claim 1.

7. A pipe for a nuclear reactor, formed of the austenitic stainless steel according to claim 1.

8. A structure in a nuclear reactor, formed of the stainless steel obtained by the manufacturing method according to claim 4.

9. A pipe for a nuclear reactor, formed of the stainless steel obtained by the manufacturing method according to claim 4.

10. A structure in a nuclear reactor, being formed of the stainless steel obtained by the manufacturing method according to claim 5.

11. A pipe for a nuclear reactor, being formed of the stainless steel obtained by the manufacturing method according to claim 5.

* * * * *